US006089280A

United States Patent [19]

Lindblom

[11] Patent Number: 6,089,280

[45] Date of Patent: Jul. 18, 2000

[54] APPARATUS FOR CONTROL OF WEFT THREADS IN A SHAFT FRAME WEAVING MACHINE

[75] Inventor: Bo Lindblom, Osby, Sweden

[73] Assignee: Texco AB, Almhult, Sweden

[21] Appl. No.: 09/336,772

[22] Filed: Jun. 21, 1999

[30] Foreign Application Priority Data

Aug. 31, 1998 [SE] Sweden ..... 9802917

[51] Int. Cl.[7] ..... D21F 1/12

[52] U.S. Cl. ..... 139/11; 139/383 AA; 28/141

[58] Field of Search ..... 139/383 AA, 11; 28/141; 162/904; 428/61

[56] References Cited

U.S. PATENT DOCUMENTS

| | | | |
|---|---|---|---|
| 1,513,506 | 10/1924 | Holt et al. . | |
| 2,903,021 | 9/1959 | Holden et al. . | |
| 4,410,015 | 10/1983 | Koller et al. . | |
| 4,557,025 | 12/1985 | Eglin | 28/141 |
| 4,581,794 | 4/1986 | Oldroyd et al. | 28/141 |
| 4,658,863 | 4/1987 | Errecart . | |
| 4,736,499 | 4/1988 | Kopcke | 28/141 |
| 4,771,814 | 9/1988 | Quigley . | |
| 5,360,038 | 11/1994 | Sano . | |
| 5,411,063 | 5/1995 | Hacker et al. . | |

FOREIGN PATENT DOCUMENTS

| | | |
|---|---|---|
| 0236601 | 9/1987 | European Pat. Off. . |
| 0502635 | 9/1992 | European Pat. Off. . |
| 0597495 | 5/1994 | European Pat. Off. . |
| 1066975 | 4/1967 | United Kingdom . |

*Primary Examiner*—Andy Falik
*Attorney, Agent, or Firm*—Pollock, Vande Sande & Americk

[57] ABSTRACT

A weaving machine arrangement incorporates a shaft frame machine and, arranged on both sides thereof, two Jacquard machines. The weaving machine arrangement is coordinated/controllable and first warp threads for the woven material are obtained from the shaft frame weaving machine and second warp threads are obtained from the Jacquard machines. A tubular material is formed from top and bottom plies which are connected by turnover fold areas. The second warp threads are used to form the spread-out turnover fold areas in the tubular material. The Jacquard machines are controlled to form patterns for closing locations of the weft threads in the turnover fold areas. By using spread-out turnover fold areas and spreading the closing locations of the weft threads in these areas, high-strength piecing functions are obtained in the tubular weave. Also, the level of automation is increased in relation to conventional production.

17 Claims, 11 Drawing Sheets

APPARATUS FOR CONTROL OF WEFT THREADS IN A SHAFT FRAME WEAVING MACHINE

TECHNICAL FIELD

The present invention relates to a control arrangement for a shaft frame weaving machine or weaving machine arrangement comprising such a machine for realizing in the arrangement or the machine a tubular product, for example forming wire, which comprises essentially flat-woven top and bottom plies and their combined turnover fold areas and in which weft threads can be guided through sheds formed in one or more warp thread assemblies.

BACKGROUND OF THE INVENTION

Control arrangements for such types of weaving machines and arrangements are known. Thus it is known, for example, to provide a control function where a tubular weave is woven in shaft frame weaving machines which operate with a spool shuttle for drawing a draw-in thread through sheds formed with the warp threads. The control functions herein relate to the weaving of flat-woven material which is removed from the machine and is subsequently folded and pieced together at its free ends. The weave thus extends in the longitudinal direction of the warp threads and the tubular weave is established through piecing-together of the free ends of the warp threads. The joining must in this case be carried out in a sewing department. The joining work takes place in a piecing area extended in the longitudinal direction of the warp threads and it is known to distribute within the piecing area the exit positions-of the warp thread ends such that a strong joint is obtained. The joining work carried out in the sewing department has in itself partially been automated so that parts of the joining work could be carried out using a Jacquard machine. Control functions for Jacquard machines are previously known in this context.

SUMMARY OF THE INVENTION

There is a need to increase the level of automation in tubular weave production while maintaining high strength in the turnover fold area. There is thus, for example, a desire for the whole or parts of the work in the sewing room to be eliminated, at the same time as the automated weave production enables the woven tubular weave to exhibit essentially the same strength around the whole of the circumference. For this, a special control arrangement in the shaft frame weaving machine or weaving machine arrangement is required. The object of the invention is to solve, among things, this problem.

The use of tubular weaving with a bobbin shuttle leads to quality problems, since the tensile stress in the weft threads cannot be kept uniform and appropriate, which means varying tensile effects upon the outer warp threads. Control functions in connection herewith are therefore unusable. The invention solves this problem by indicating a new path within the technology. Instead of controlling the piecing function of warp thread ends, a control arrangement according to the invention pieces the weft thread ends together in the actual shaft frame weaving machine or weaving machine arrangement.

The new control functions should be usable on tried and tested technology and not should require overextensive conversion and design modification to the structures of existing shaft frame weaving machines. This problem too is solved by this invention.

According to the inventive concept, in respect of a respective turnover fold in the tubular weave, a relatively extended turnover fold area extending transversely across the warp threads shall be able to be maintained and the closing locations for the weft threads separated such that weaknesses do not arise in the joint. This problem too is solved by the invention.

According to the inventive concept, the closing locations are treated as a pattern which should be chosen with existing program controls (punched card control systems) to give optimal or adequate strength in the turnover fold joint. This problem too is solved by the invention in a technically simple manner.

According to the inventive concept, a shaft frame weaving machine with grippers for draw-in thread, which is known, is supplemented by a weaving machine or weaving machines for patterning the weave, for example Jacquard machines. There is here a need for controls of optimally arranged machines, warp thread assemblies, lease functions and draw-in thread assemblies so that a technically perfect weaving product is obtained. This problem too is solved by the invention.

There is therefore a purely general problem of obtaining perfect controls of the shaft frame weaving machine and weaving machine arrangement. This problem too is solved by the invention.

A control arrangement according to the invention is charaterized in that it provides a first control function for a member which cuts off the respective weft thread during weaving and a second control function for a member which controls ends of cut-off weft. These control functions is/are designed so as, in the case(s) in which an end of a cut-off weft thread issuing from the top or bottom ply at the turnover fold area in question shall be guidable to a closing position between warp threads in a turnover fold area part located on the top ply and bottom ply respectively, to direct the weft thread part round about an outer warp thread or warp threads in the warp thread assembly concerned and possibly in a path above and/or below warp threads in the outer warp threads to the closing position.

In a preferred embodiment, the second control function comprises the establishment or initiation of a signal control to arms and a thread-gripping function in said controlling member, which comprises a first arm for gripping the weft thread end and swiveling in from a grip location to a location inside an established shed beneath the particular pair of warp threads between which the closing position is located.

Also included within the improvements is that the second control function comprises the establishment or initiation of a second signaling to a second arm which, in dependence on the second signaling, operates with movements coordinated with the first arm and with a thread take-up function by means of which the thread end can be drawn out by means of the second arm from the inner space of the shed between the pair of warp threads to up above the upper warp threads of the shed.

According to the inventive concept, the first arm is designed to operate, by means of the first signaling, with a thread take-up function, by means of which the thread end can be drawn down by means of the first arm from the top side of the upper warp threads of the shed down into the inner space of the shed. The arrangement can also be designed with a control unit with computer-related or punched-card-related equipment by means of which the first and second signalings can be established or initiated. Similarly, the arrangement can establish or initiate a third signaling which causes the second and third warp thread assemblies to operate at a faster repetition rate in their lease functions than the first warp thread assembly in order in an alternate-working function first to realize a patterning function for the locations of the closing positions in the respective turnover fold area or turnover fold area part and secondly to realize a patterning function for the woven material.

In one embodiment, the control arrangement establishes or initiates a fourth signaling which directs the thread-end-controlling members to control the thread ends in respect of alternate lease establishments when the shaft frame weaving machine realizes its pattern function in the woven material. The fourth signaling establishes or initiates a patterning function for the closing positions in the particular turnover fold area or turnover fold area part in respect of the activity.

In further embodiments, the control arrangement establishes or initiates a fifth signaling to (a) Jacquard machine(s) on one or both sides of the shaft frame weaving machine. The respective Jacquard machine hereupon offers up its warp thread assembly of the second and third warp thread assemblies.

The fifth signaling can further establish or initiate that the respective Jacquard machine operates at accelerated frequency so as on alternate occasions to realize patterning of the closing positions in the turnover fold area or the turnover fold area part and on alternate occasions to establish a patterning function in the woven material.

The respective machine in the weaving machine arrangement can be designed with a signal control unit (41', 42, 43) which can be controlled from an operating unit for the weaving machine arrangement or the shaft frame weaving machine. In addition, the signal control units can be integrated in or with the operating unit (44) and the pattern program of the shaft frame weaving machine and of the Jacquard machine(s) can be integrated or coordinated. A pattern program part for the locations of the closing positions in the respective turnover fold area or turnover fold area part is preferably controlled by or by means of a random generator function. In one embodiment, a particular signaling controls an integrated unit with gripper-controlling and thread-end-controlling members.

As a result of the above, time gains are achieved by virtue of the fact that joining of the woven top and bottom materials via loose thread ends by manual means in the sewing department is avoided. An increased level of automation is also achieved by the fact that the fixing of the positions of the draw-in threads does not need to be carried out manually, but can be signal-controlled according to the invention. In tubular products of, for example, 25 meters diameter and approx. 6 meters length, the time gains can be in the order of 1–2 weeks compared with earlier manual processes for thread joining. The work in the sewing department can be eliminated. In addition, two Jacquard machines, one on each side, can be applied to or built on to an existing shaft frame weaving machine operating with grippers for the weft thread, which is conducted into respective leases realized with the warp threads. Using the control arrangement, the shaft frame weaving machine is herein able to control its leases and the Jacquard machines their leases, all of which leases can be coordinated for the respective draw-in thread, the pattern controls in or from the Jacquard machines determining the positions for the drawn-in draw-in threads in the turnover fold area. Using a random pattern function in the respective Jacquard machine, a highly effective strength is achieved in the turnover fold area. A member for controlling the thread ends is used to direct weft threads or the bottom ply to a piecing area located on the bottom and top ply respectively. The arrangement here allows uniform tensile stress distribution in the drawing around (an) outer warp thread(s). The arrangement also allows the use of separate piecing threads between positions in the top and bottom ply.

BRIEF DESCRIPTION OF THE DRAWINGS

A currently proposed embodiment of an arrangement, method, device and application, and a tubular product, shall be described below with simultaneous reference to the appended drawings, in which.

DETAILED DESCRIPTION OF THE PREFERRED EMBODIMENTS

Figure 1:
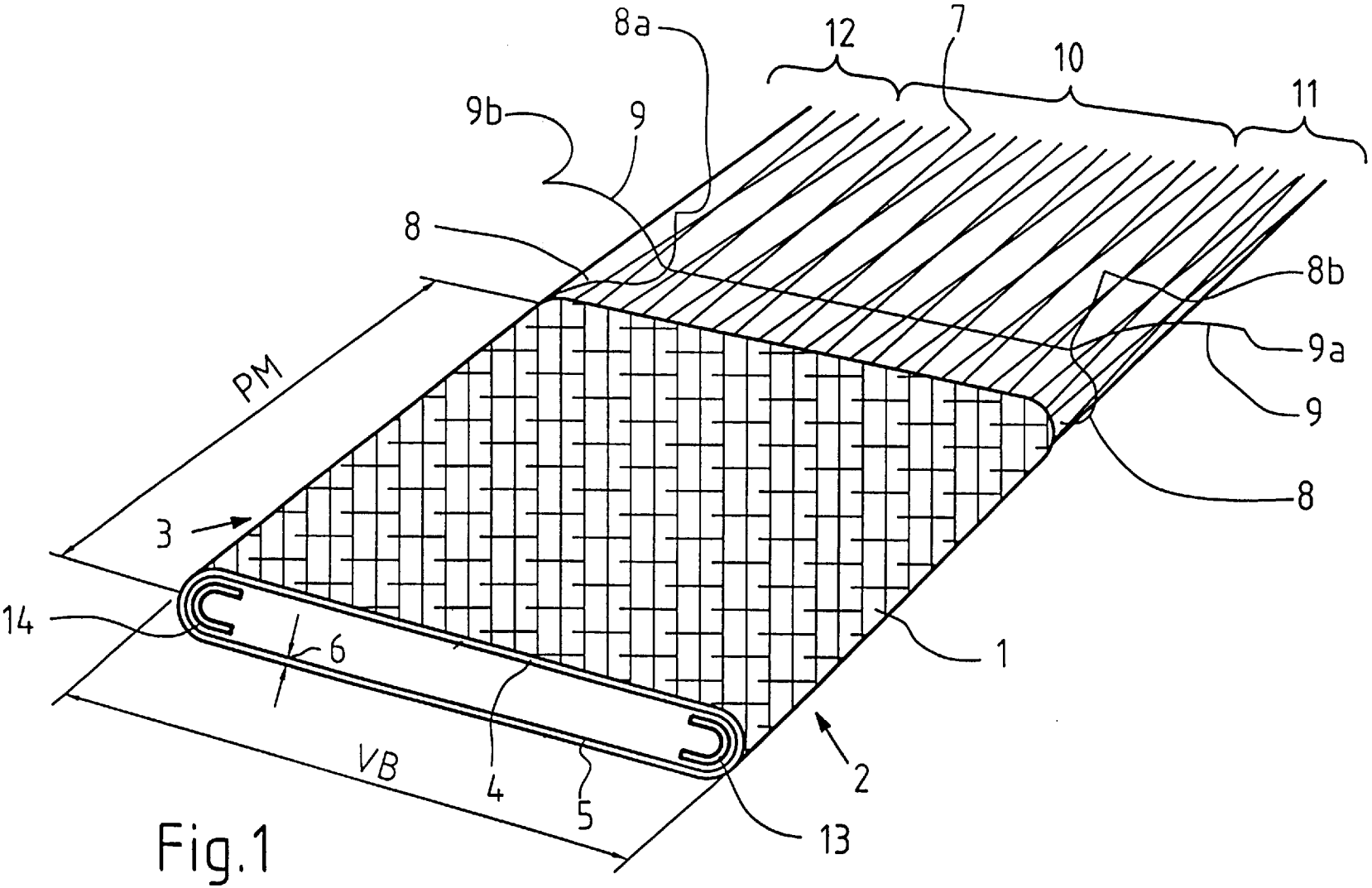
FIG. 1 shows in a view obliquely from above from the right a tubular weave during production, in which warp threads are arranged to form a shed.

In FIG. 1, a tubular product is denoted by 1, the weaving width of the product being indicated by VB and the weaving length being indicated by PM. The invention is assignable first of all to the weaving of products with weaving widths of 18 meters and weaving lengths of 12 meters. The product can be constituted by tubular weave intended for use in papermaking machines. It is important for the tubular product to exhibit high quality and high strength around the whole of the circumference. By high strength it is meant here essentially that strength which is generated in conventional flat-weaving and joining in a sewing department. The product is woven in a shaft frame weaving machine with grippers, which means that top and bottom cloth weaves can be pieced together at the sides 2 and 3, using the weft threads in the weave.

The product 1 shown in FIG. 1, in the form of a tubular weave, is in the process of being woven. The tubular weave comprises two turnover fold areas 2, 3, which combine basically flat-woven top and bottom plies 4, 5 of a thickness 6. Each ply can consist of a double layer of warp threads lying one on top of the other and a binding thread for these and the weft threads. Warp threads, extending in the longitudinal direction of the product 1, are labeled 7. In a known manner, the weaving machine in question operates with a lease function and weft or draw-in threads, which are pushed through or drawn through a respective shed in the transverse direction of the warp threads. The weaving machine is also provided with gripper and cut-off members (not shown in FIG. 1) on the respective sides. With the cut-off members, the respective drawn-in or pulled-through thread is cut off at its two ends. Cut-off weft thread ends are brought together in the pattern such that the closing end of a drawn-in and cut-off thread is arranged in connection with the starting end of a following thread, etc. In FIG. 1, cut-off weft threads are indicated by 8 and 9 and the ends of the threads by 8*a*, 8*b* and 9*a*, 9*b*. In a preferred embodiment, the thread end 8*b* can be brought together with the end 9*a* of the preceding weft thread 9, etc.

In FIG. 1, the warp thread mat in the weaving machine arrangement consists of three parts. A first part 10 is obtained with a shaft frame weaving machine (not shown), which can be conventional in type. A second part 11 is obtained by a Jacquard machine (not shown) or corresponding patterning machine or patterning function. A third part 12 is obtained from a second Jacquard machine (not shown). The lease functions of the shaft frame weaving machine and Jacquard machines are coordinated such that sheds are established for the draw-in threads 8, 9 in the respective machine type. According to the invention, the warp thread parts 11 and 12 are divided up for piecing site areas at the sides 2 and 3 of the woven product 1. The piecing site areas are here also referred to as turnover fold areas. The respective turnover fold area is relatively spread out. In FIG. 1, the spread of the turnover fold areas has been symbolized by bidirectional arrows 13 and 14. In the shown embodiment, the respective turnover fold area comprises approx. 450 warp threads in width when viewed radially. Each turnover fold according to FIG. 1 consists of two parts arranged one over the other, one located on the top ply and one on the bottom ply, the respective part being approx. 450 warp threads wide.

Figure 2:
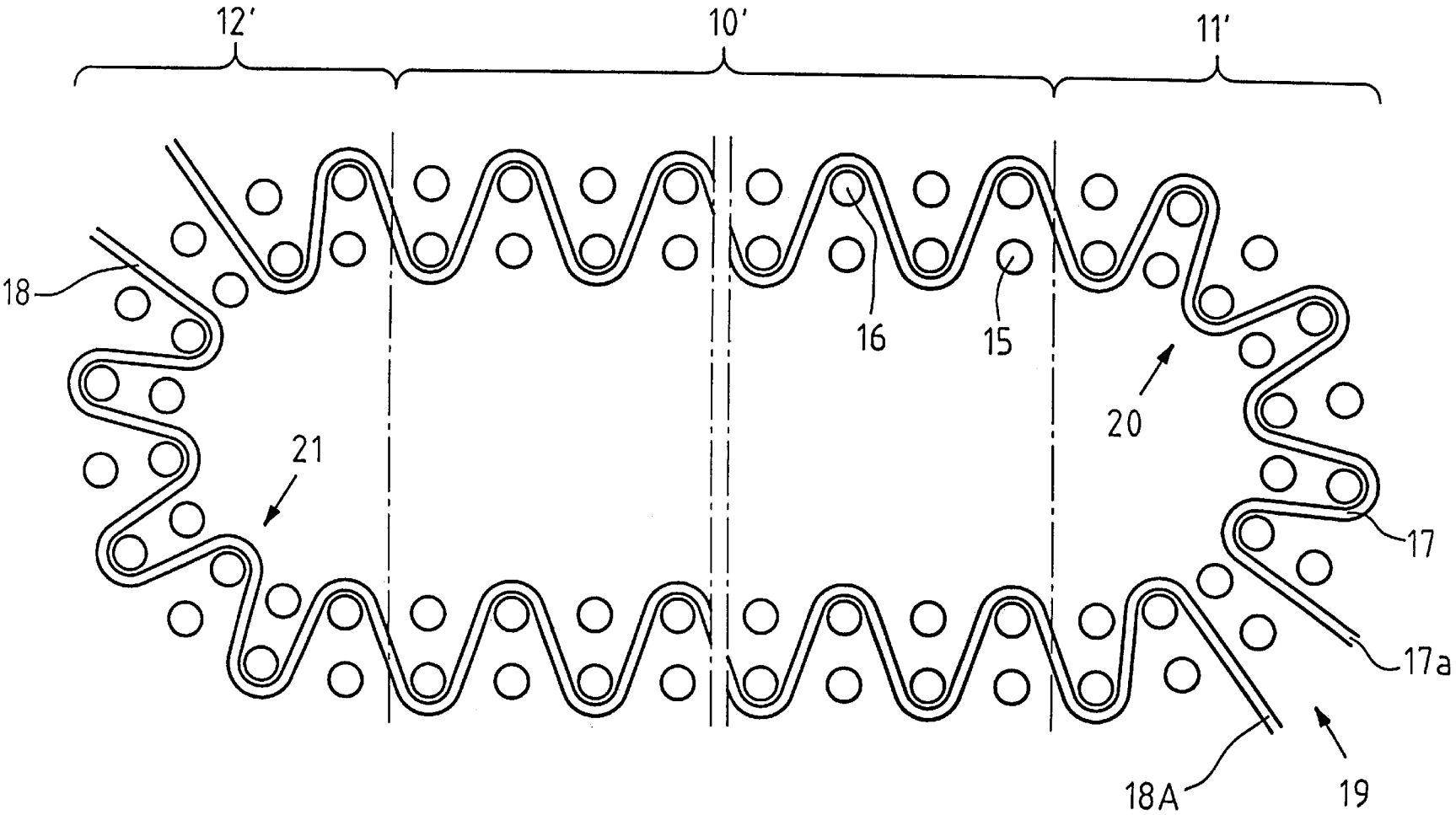
FIG. 2 shows in cross section an example of the mutual relationship between warp threads and weft threads in connection with the piecing or turnover fold areas and the basically flat-woven areas.

According to FIG. 2, in the woven product, which in the cross section in question in the longitudinal direction is composed of two warp thread layers 15 and 16, weft threads 17 and 18 shall be drawn through around the shown cross section circumference. The binding thread is not shown in this example. The thread ends 17*a* and 18*a* can be brought together at a first closing position or a first changeover site 19. In FIG. 2, a changeover site or closing position for two other threads (not shown) is indicated by 20 and a changeover or closing position for two third threads is denoted by 21, etc. The changeover sites or closing positions 19, 20 and 21 are located in the turnover fold areas 11' and 12'. The area 10' has no such changeover site or closing positions. The weft thread ends 17*a*, 18*a* can obtain a closing position between the same pair or successive pairs of warp threads in the tubular weave. By the term warp thread pair it is here meant the pair of warp threads in the lower or the upper layer. The respective thread end is led out through the warp thread pair of the lower layer as well as through the warp thread pair of the upper layer. In the present case, the warp thread pairs of the top and bottom ply have a common warp thread. Alternatively, the respective weft thread ends which are to be brought together or arranged in connection with each other can extend through the same warp thread pair or through widely spaced warp thread pairs. In one embodiment, moreover, the thread end parts can be drawn past each other, so-called "cross-laying". In this case, the respective thread end passes the warp thread pair of the other thread end, viewed in the direction of the circumference.

Figure 3:
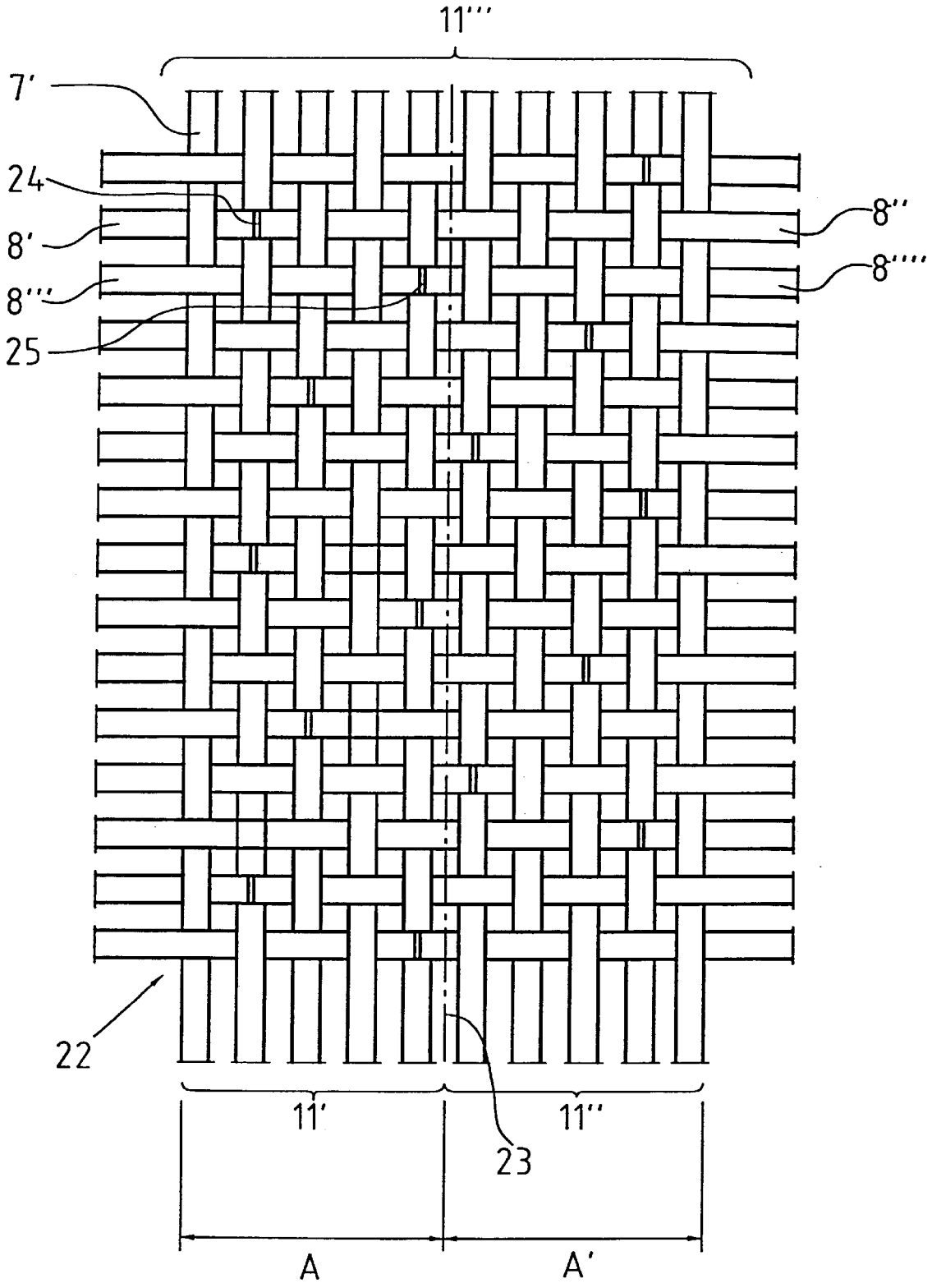
FIG. 3 shows in horizontal view parts of a turnover fold area spread out in the horizontal view.

In FIG. 3, parts 22 of a turnover fold area are shown spread out in a horizontal plane. The warp threads are denoted by 7' and the weft threads by 8', 8" and 8'", 8"". An edge line through the turnover fold area in the direction of the warp threads is indicated by 23. The turnover thread area 22 basically consists of two parts 11' and 11" lying one over the other, which are therefore, according to FIG. 1, served by a Jacquard machine. In FIG. 3, the total spread width has been indicated by 11'". The part 11' thus belongs to the top cloth and the part 11" to the bottom cloth, see also the arrows 13 in FIG. 1. In FIG. 3, the closing locations (the changeover sites) for the various brought-together or mutually approachable thread ends are also shown. A first closing location for the weft threads 8, 8" is thus denoted by 24, a second closing location for the threads 8'", 8"" by 25, etc. As can be seen from FIG. 3, some closing locations will end up at the first turnover fold part 11', belonging to the top cloth, and other closing locations at the second turnover fold 11', belonging to the bottom cloth. The fact that closing locations are not placed essentially alongside each other, for example along an edge line parallel to the line 23 in the spread-out turnover fold area, but are spread out in the spread-out turnover fold area, produces high strength in the woven material in the joints on the sides 2 and 3 (see FIG. 1). From the edge line 23, the turnover fold areas extend with distances A, A' in over the woven material, see above. The distances A, A' are preferably equal in size. Alternatively, only that part of the turnover fold which is located on the top or bottom side is used to embrace closing or exit positions for weft thread ends. Preferably, the turnover fold part of the top ply is used. This means that weft threads which issue from the top or bottom ply and are assigned to a closing position of the bottom and top ply respectively shall be rearranged and possibly threaded between outer warp threads. This is an essential part of the invention and is described in greater detail below.

Figure 4:
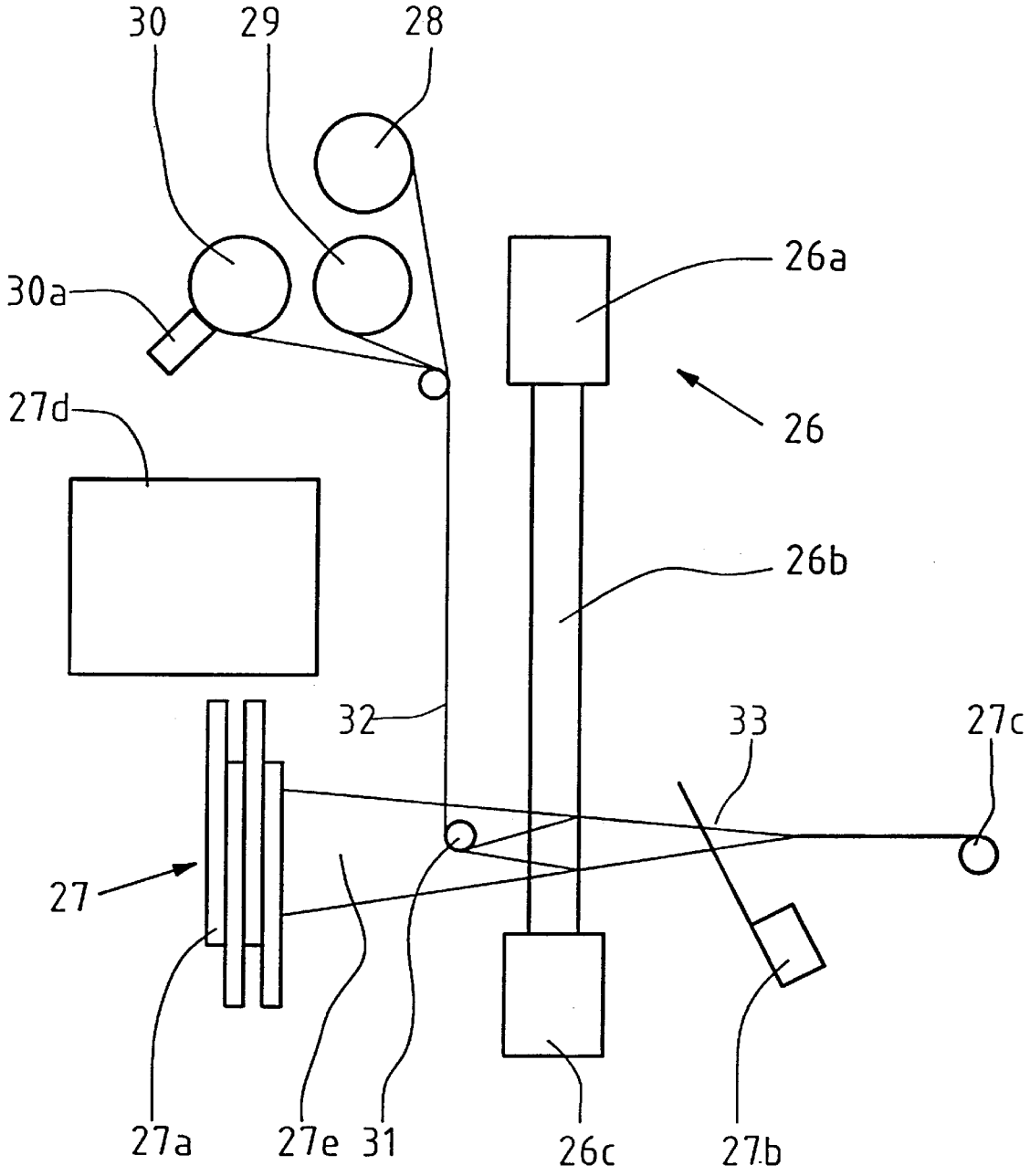
FIG. 4 shows from the side shaft frame weaving and Jacquard machines forming part of a weaving machine arrangement.

In a preferred embodiment, according to FIG. 4, a Jacquard machine 26 is used on each side of a shaft frame weaving machine 27 (or rather at the respective turnover fold area), which is symbolized by its shaft frames 27*a*, reed 27*b*, cloth beam 27*c* and main part 27*d*. As an example of a shaft frame weaving machine, reference is made to the TM300 machine marketed by TEXO AB, SE. Since the working of the shaft frame weaving machine is well known, it shall not here be described in further detail.

The Jacquard machine too is well known and is characterized by the fact that it achieves patterning of woven textile material. The working method of the Jacquard machine is used in the present invention to "pattern" the abovenamed closing positions. By distributing the closing positions according to a certain pattern achieved by the Jacquard machine, optimal or high strengths can be achieved in a technically simple manner which, moreover, by virtue of the fact that the whole piecing process for the woven tubular wire is placed in the weaving machine arrangement, increases the level of automation. The manual threadknotting work in the sewing department is wholly eliminated and machine downtimes are radically reduced. The pattern can be chosen for the closing positions randomly through controlling of the Jacquard machine or according to a certain predetermined pattern which guarantees high strength.

In FIG. 4, the Jacquard machine 26 is represented with main part 26*a*, from which hooks or clasps, which can be interacted with the warp threads of the Jacquard machine, hang down in cords 26*b* or equivalent. By acting upon certain of the cords, lease functions together with weight(s) 26*c* are obtained. This function is well known and shall not therefore here be described in further detail. Reference is made to the Jacquard machine "DRACUP 432×48 seaming machine" sold on the open market. The Jacquard machine is allocated three warp thread bobbins 28, 29, 30, which each represent their warp thread quality and can therefore be engaged alternately. The above-described warp thread layers in the respective ply can be constructed, for example, in varying grade of quality. Each bobbin can be provided with its own load cell function 30*a* for fixing the warp thread tension in the system. In FIG. 4, a control beam 31 for redirecting the warp threads 32 for connection to the warp thread 33 of the shaft frame weaving machine is also shown.

Figure 5:
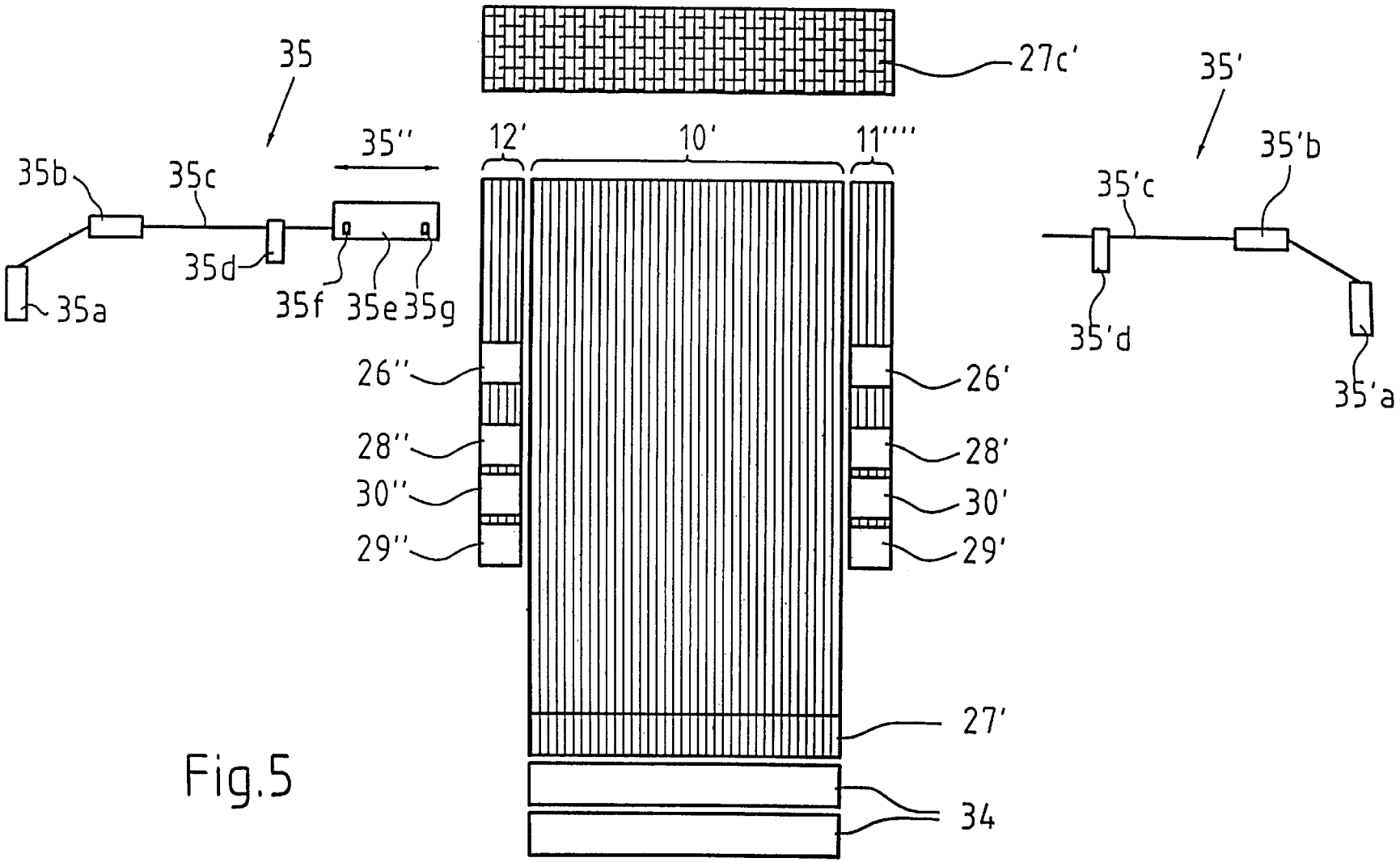
FIG. 5 shows from above parts of the weaving machine arrangement with shaft frame machine and Jacquard machines.

In FIG. 5 it is shown that a Jacquard machine 26' and 26" is respectively disposed on each side (and somewhat in front) of the shaft frame machine 27', which offers up warp threads 10' from one or more bobbins 34 in a known manner. The Jacquard machines deliver, according to the above, the warp threads 11"" and 12'. All warp threads are fed in on a joint cloth beam or a joint cloth beam system 27*c*'.

The machine arrangement comprises weft-thread-realizing equipment 35, 35' on each of its sides. The respective item of equipment incorporates a spool 35*a*, 35'*a*, a feed wheel 35*b*, 35'*b*, a weft thread 35*c*, 35'*c* and a gripper 35*d*, 35'*d*. A shuttle 35*e* with pincers 35*f*, 35*g* for cutting off the weft thread takes up a present location on the one side of the arrangement. The described equipment 35, 35' is known in terms of structure and function and shall not therefore here be described in further detail. The path of direction of the shuttle is labeled 35". In connection with an exemplified structure, six grippers, three warp beams, two Jacquard machines and a spool stand for 400 threads or three bobbins can be used.

Figure 6:
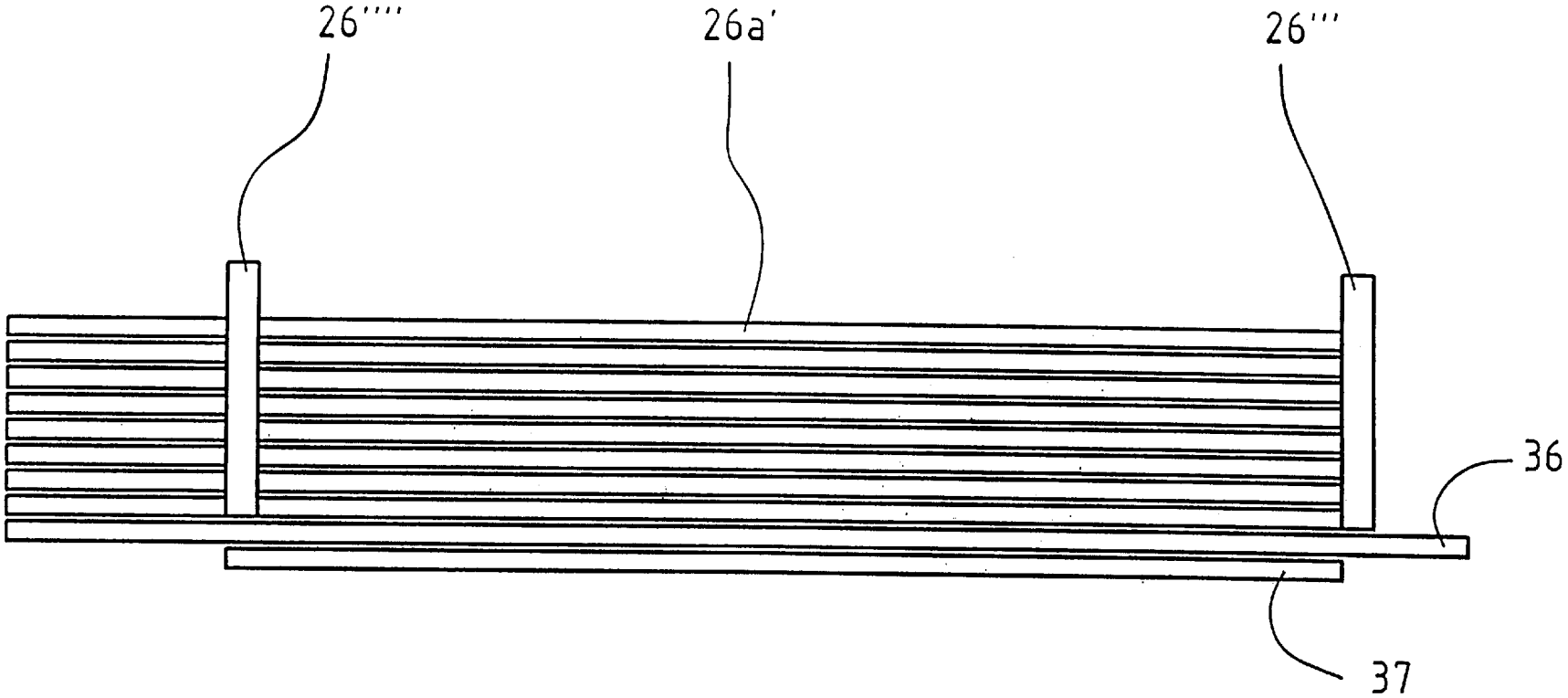
FIG. 6 shows from above the application of the Jacquard machines in connection with the shaft frames of a shaft frame machine and also the subsequently arranged airbox block and internal expander.

FIG. 6 shows an example of the application of the two Jacquard machines 26'" and 26"" to shaft frames 26*a*' of the shaft frame weaving machine, which can be, for example, 24 or more in number. In addition, an airbox block or a projectile firing arrangement 36 known type has been indicated in basic representation. Moreover, an inner expander 37, arranged in or on or by the machine, is also indicated in basic representation.

The shaft frame weaving machine and the Jacquard weaving machines therefore together form a weaving machine arrangement in which an essentially known shaft frame weaving machine is combined with essentially known Jacquard machines. The only differences which exist in relation to the known machines are the lesser matchings in the executable controls and the fact that the Jacquard machines, apart from patterning the weave, also realize a patterning of the positions for the closing locations in the turnover fold areas. Moreover, thread-redirecting members shall be provided, which guide the thread end of the weft thread in the top ply or bottom ply to a closing position in the turnover fold part of the bottom and top ply respectively.

Figure 7:
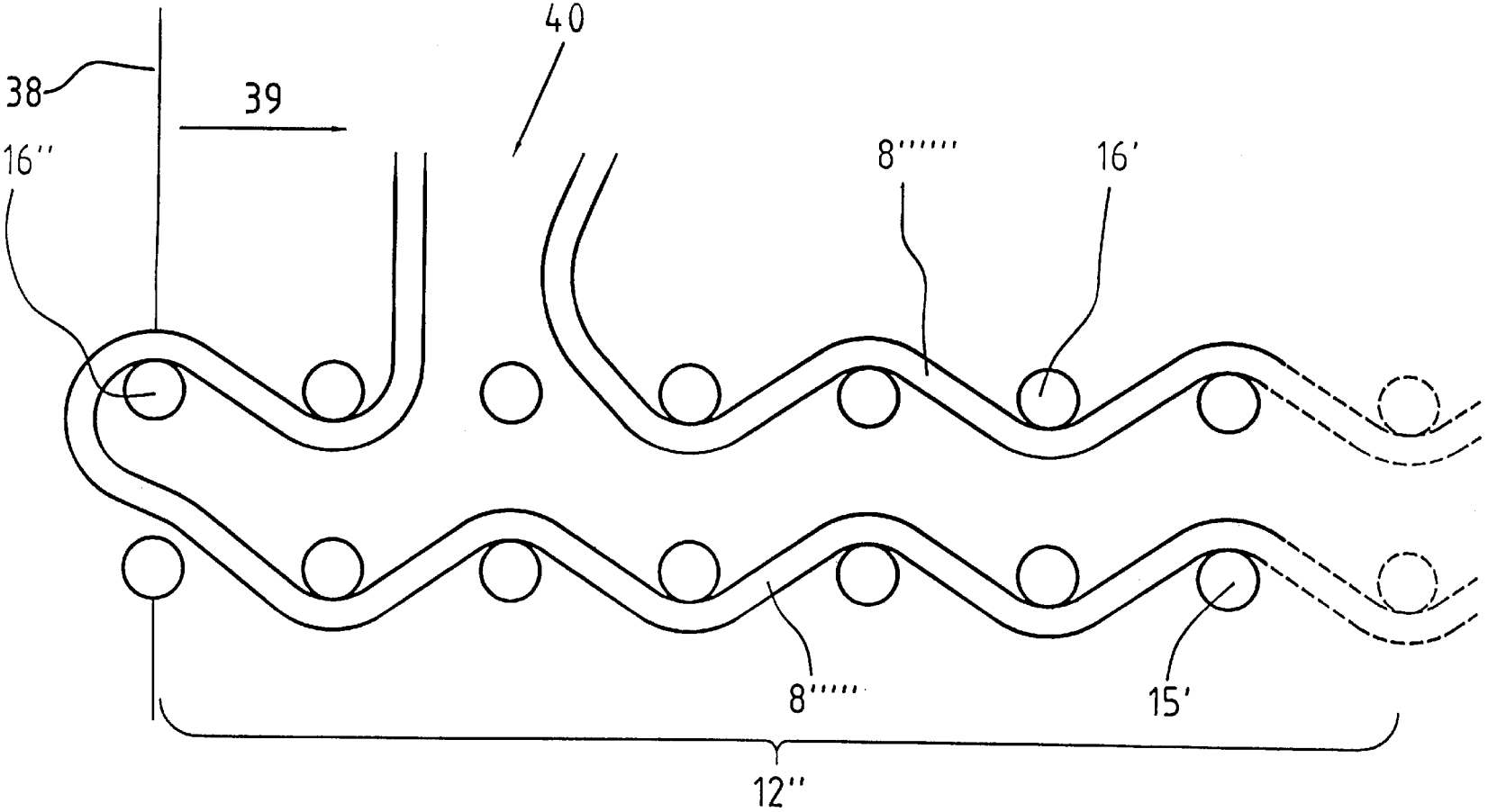
FIG. 7 shows in cross section the drawing of weft threads in the warp threads in a turnover fold area.

In order to simplify the description of the invention, FIG. 7 indicates a top and bottom pile with one layer each of warp threads and shows in basic representation a turnover fold area in which, in the bottom cloth warp 15', a weft thread 8"""" has been drawn through all the warp threads and, in the top cloth warp 16', the weft thread 8"""" has been drawn out between the third and fourth warp thread from the outer edge 38 or the outer warp thread 16". The thread is herein wrapped round the outer warp thread 16" and guided inward according to the weave pattern in the direction 39 to the joining site 40 between an inner warp thread 16'" in the joining function. This function is executed automatically in the arrangement.

Figure 8:
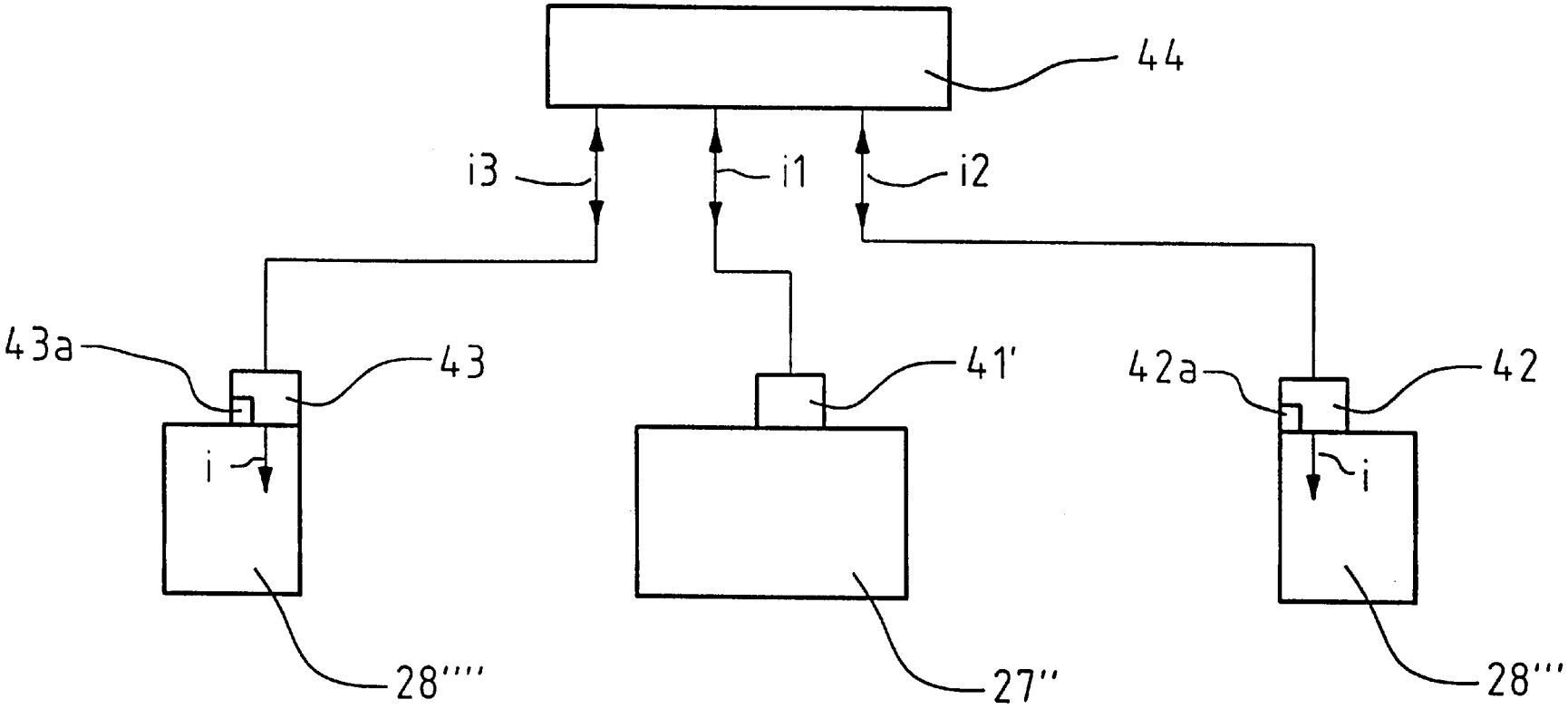
FIG. 8 shows in basic diagram form a control unit arrangement for the weaving machine arrangement.

FIG. 8 shows the control functions for the shaft frame weaving machine 27" and the Jacquard machines 28'" and 28"". The respective machine is designed with a signal control unit 41' and 42, 43, which can be controlled from an operating unit 44 for the weaving machine arrangement. The units 41', 42 and 43 can alternatively be placed in or by the unit 44. The Jacquard machines are controlled with known software in order to establish "pattern formation" for closing locations of the weft threads and patterning of the weave in the turnover fold areas. The shaft frame weaving machine is controlled with known software for establishing the pattern for the basically flat-woven top and bottom cloths (the wires). To the pattern program of the Jacquard machine there is introduced a pattern control function, which corresponds to the pattern control function of the shaft frame machine, such that the woven material obtains the same pattern in the top and bottom parts and in the turnover fold areas. This interaction of the software can be realized in a known manner. The controlling of the particular pattern in the tubular weave and the setting of the pattern image for the closing locations in the turnover fold areas can be effected from the control unit 44 and/or, by way of supplementation, separately from the units 41', 42, 43. For the pattern formation of the closing positions, a random generator function, labeled 42*a* and 43*a* in FIG. 9, can be used. The patterns for the closing positions can be similar in the two turnover fold areas or can differ. What is essential is that strong turnover folds are obtained in the machine arrangement. By means of the control arrangement, the drives for the the shaft frame weaving machines and Jacquard machines are also coordinated.

As a result of the above-proposed, a tubular forming wire is obtained, which also incorporates a gripper system. The production of the total product in the weaving machine arrangement, according to the above, yields savings of 2 weeks in the production of the forming wire, which can now be produced in a third of the time previously required. A substantially increased level of automation or level of rationalization is thus obtained and the increased level of automation is herein compared with that which is present when there is necessary splitting of the warp threads of the woven material at the turnover fold in the sewing department. In FIG. 4, a lease has been labeled 27*e*. This notation relates to both the lease in the shaft frame weaving machine and the leases in the Jacquard machines 26', 26", which are mutually synchronized. In FIG. 5, the grippers have been labeled 35*a* and 35*a*'. In FIG. 8, the controls of the respective Jacquard machine 28'" and 28"" of the control units 42 and 43 have been labeled i and i' respectively. The control functions between the unit 44 and the units 41', 42 and 43 have been labeled i1, i2 and i3.

Figure 9:
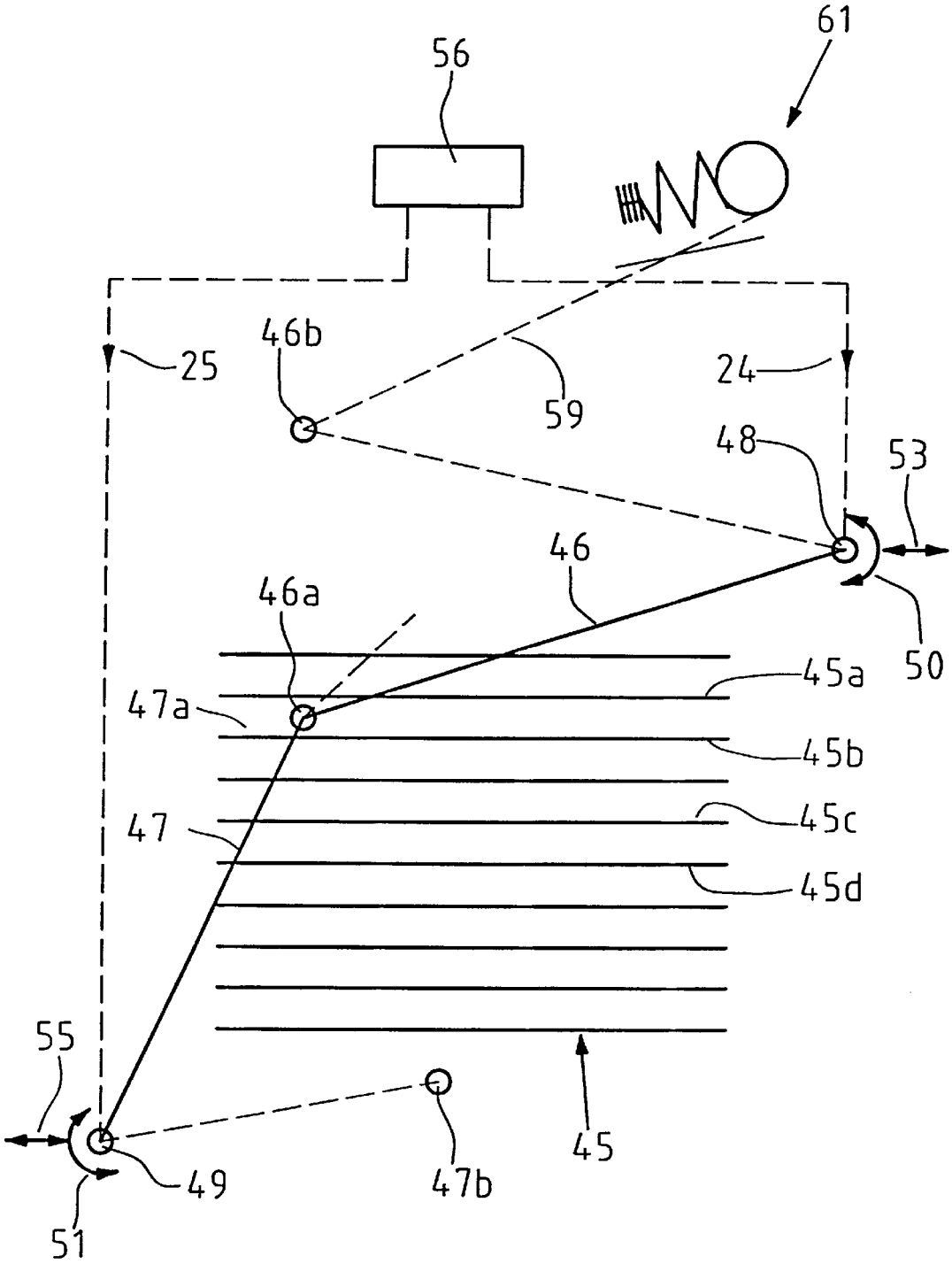
FIGS. 9 and 9*a* show in basic representation a thread-end-controlling member in horizontal and vertical views respectively.
Figure 9A:
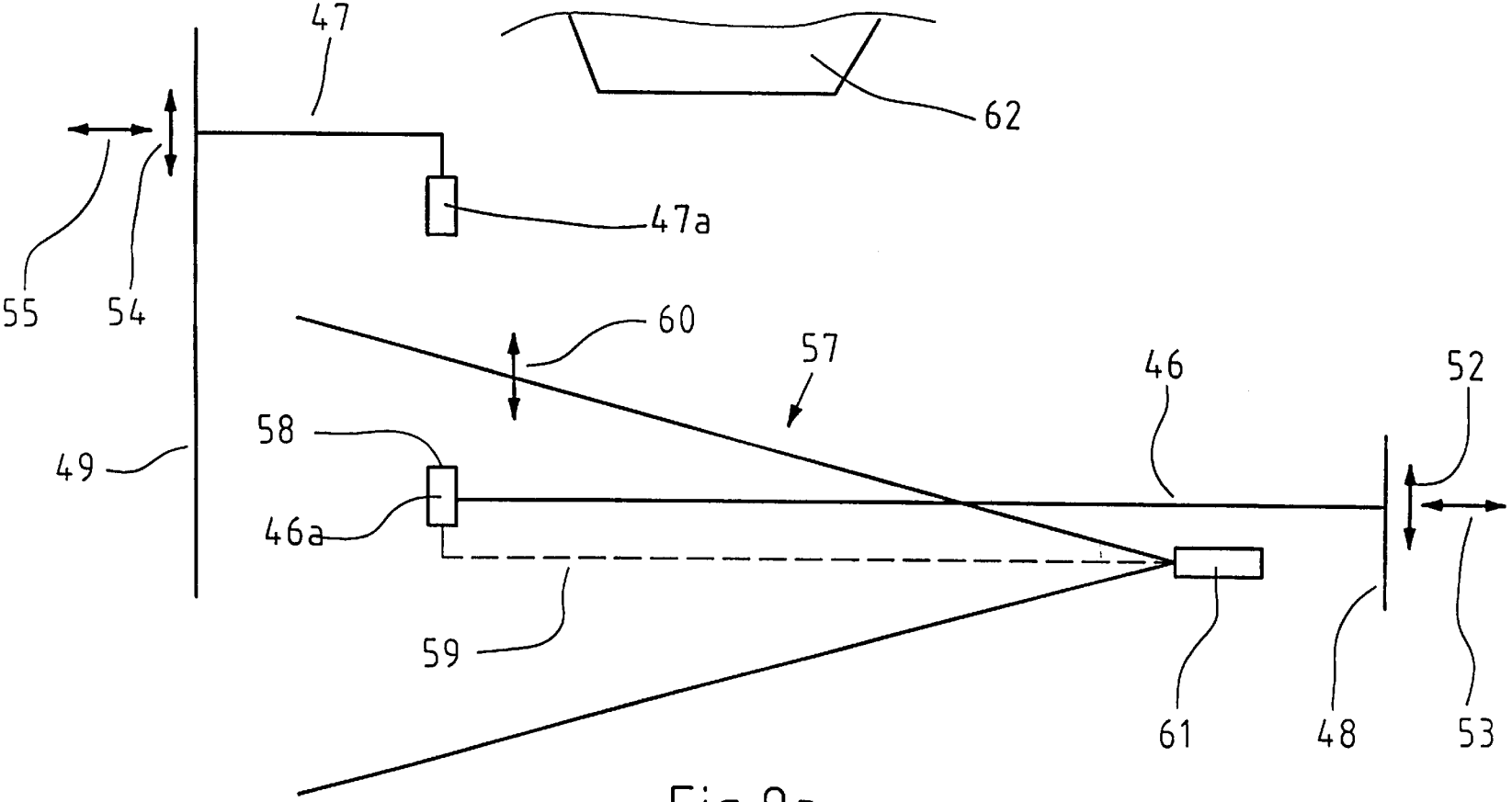

In FIGS. 9 and 9*a*, examples are shown of thread-controlling members which operate in connection with leasing for warp threads 45. In the illustrative embodiment, the members comprise two pivotal arms 46, 47. The arms can be swiveled with bearing axes 48, 49 in the directions of the arrows 50, 51. The axes 48, 49 are moreover displaceably disposed in mutually perpendicular directions 52, 53 and 54, 55 respectively. The maneuvering of the axes, i.e. the arms 46, 47, is effected from the control unit 56, which can form the control unit for the arrangement, the Jacquard machine, etc. The swivel arms have members 46*a*, 47*a*, which are interactable with thread ends and which can be actuated to the locations represented by continuous lines in FIGS. 9, 9*a* or to different locations, for example the locations represented by dashed lines 46*b*, 47*b*. The first-named locations are located inside the warp thread shed and the last-named locations are located beside the warp threads. In the last-named locations, the swivel arm 46 has captured with its member 46*a* an end 58 of a weft thread 59 and introduced it into the shed 57. In dependence upon controls or electrical control signals i4, i5, etc., the thread end can be directed into the shed and placed opposite a space between a pair of warp threads, for example the warp thread pair 45*a*, 45*b*. The swivel arms are actuated in directions 60 away from and toward each other. When the interacting members 46*a*, 47*a* are actuated such that they are mutually opposed in the vertical direction, they are activated toward each other through controlling from the unit with the signals i4, i5, etc., such that the member 47*a* can interact with the member 46*a* and, by virtue of a known take-up function, can take up the thread end from the member 46*a* and draw it up between the warp thread pair 45*a*, 45*b*, above which it releases the grip on the thread end once this has reached its final position. If this is not the case, the swivel arms can be further actuated by the unit into the warp thread shed, for example to the space between the warp thread pair 45*c*, 45*d*, whereupon the member correspondingly takes up the thread end from the member 47, etc. until the correct/desired position has been reached for the thread end in question. The weft thread is fed in via (a) thread-tension-determining member(s) 62, by which a uniform desired tension is able to be maintained during the ongoing piecing process in the machine. As a supplement or alternative to the member 47, 47*a*, an air suction arrangement 62 can be used, which can be of known type and by means of which the thread end can be sucked up between the warp threads. Warp thread drawing can thereby be realized in the one ply and the turnover fold is located in the other ply, or vice versa (cf. FIGS. 2, 3 and 7). The Jacquard machine or equivalent operates at an accelerated repetition rate or frequency such that the normal patterning of the weave can also be executed. In FIGS. 9, 9*a*, the shown arrangement can be integrated with the gripper function in the shaft frame machine.

Figure 10:
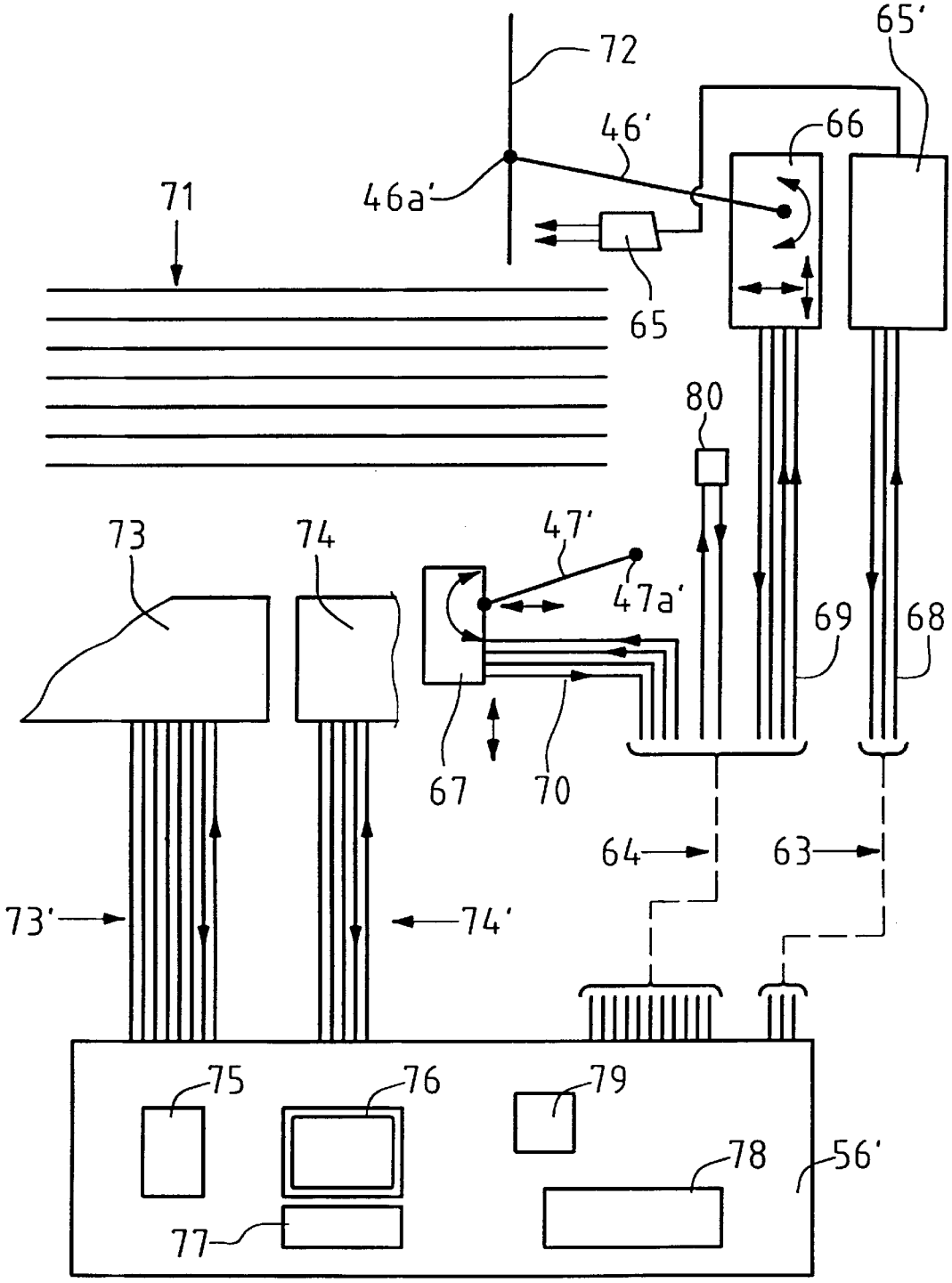
FIG. 10 shows in horizontal view and in basic representation electric power control functions according to the invention.

The thread-end-controlling members are therefore designed so as, in the event of a cut-off weft thread emanating from the top ply or bottom ply being assigned a closing position for its end which is located in the turnover fold area of the respective bottom and top ply, to direct the cut-off weft thread around and possibly through the outer warp thread or warp threads. The lease function realizes the closing position for the end of the weft thread, when this emanates from that same ply of the top ply and bottom ply which comprises the turnover fold area on which the closing position is to be located. FIG. 10 shows first and second control functions 63, 64 to cut-off and thread-end-controlling members 65 and 66, 67 respectively. The member 65 receives electric signal control 68 and the members receive electric signal controls 69, 70 from a control and/or operating unit 56'. Recoupling options exist for one or more of the members through electric signaling from these. The warp threads are denoted by 71 and the weft thread by 72. A shaft machine is denoted by 73 and a Jacquard machine or equivalent by 74. The arms according to the above are denoted by 46', 46*a*' and 47', 47*a*' respectively. The unit 56' can operate with punched card and/or computer functions. Moreover, the unit operates with software 77 and is provided with a control panel 78. The machines 73, 74 can operate with wholly or partially integrated function. The software 77 comprises pattern program functions for woven tubular weave and for the closing locations in the respective concerned turnover fold area or turnover fold area part according to the above. A random generator function for optimal spread-out from the strength function of the closing positions is denoted by 79. The arms 46' and 47' operate with thread take-up functions which are controlled with the electric signalings 69, 70. The take-up function can be supplemented by an air suction function 80, which is controlled by the electric signals or the control function 64. 73' and 74' are electric control functions.

The invention is not limited to the embodiment shown by way of example above, but can be subject to modifications within the scope of subsequent patent claims and the inventive concept.

What is claimed is:

1. A control apparatus for a shaft frame weaving machine for making a tubular product, the tubular product including top and bottom plies with turnover folded areas and in which weft threads can be guided through sheds formed in one or more warp thread assemblies, comprising:

first means for controlling a member which cuts off a weft thread during weaving; and second means for controlling a controlling member to guide ends of the cut-off weft thread from the top or bottom ply around an outer one of the warp threads to a closing position between a pair of warp threads in the turnover folded area located on the top or bottom ply, respectively.

2. The control apparatus of claim 1 wherein the second means for controlling guides the cut-off end of the weft thread in a path above and below the warp threads.

3. The control apparatus of claim 1 wherein the controlling member comprises a first arm for gripping the cut-off end of the weft thread and for swiveling in from a grip location to a location inside the shed beneath the pair of warp threads between which the closing position is located.

4. The control apparatus of claim 3 wherein the controlling member further comprises a second arm for gripping the cut-off end of the weft thread and having a take-up function for taking the cut-off end from the first arm, the second arm being swivelable about a bearing axis, the second means for controlling generating a second signal controlling the second arm to move coordinated with the first arm such that the cut-off end is drawn out from an inner space of the shed between the pair of warp threads to a top side of upper warp threads of the shed.

5. The control apparatus of claim 4 wherein the second means for controlling controls the first arm to take the cut-off end from the second arm and draw down the cut-off end from the top side of the upper warp threads of the shed into the inner space of the shed.

6. The control apparatus of claim 5 wherein the second means for controlling is a computer control unit.

7. The control apparatus of claim 5 comprising three warp thread assemblies, a first warp thread assembly for the top and bottom plies and second and third warp thread assemblies for the turnover folded areas, the second means for controlling also controlling the second and third warp thread assemblies to operate their lease functions at a frequency faster than a frequency of the first warp thread assembly to realize a pattern for locations of the closing positions in the turnover folded areas.

8. The control apparatus of claim 7 wherein the second and third warp thread assemblies comprises Jacquard machines adapted to be arranged on both sides of a shaft frame weaving machine, the Jacquard machines providing the warp threads for the turnover folded areas.

9. The control apparatus of claim 8 wherein the second means for controlling controls the Jacquard machines to operate at an accelerated frequency such that they alternatingly pattern the closing positions in the turnover folded area and establish a patterning function in the tubular product.

10. The control apparatus of claim 9 wherein the second means for controlling is a signal control unit provided for each warp thread assembly, the signal control units being controlled by an operating unit.

11. The control apparatus of claim 10 wherein the signal control units are integrated with the operating unit.

12. The control apparatus of claim 9 wherein pattern programs of the Jacquard machines and the shaft frame weaving machine are coordinated.

13. The control apparatus of claim 12 wherein a pattern program for locations of the closing positions in the turnover folded areas are controlled by a random generator function.

14. An apparatus for producing a seam interconnecting a top and a bottom ply which form a tubular product, comprising:

a shaft frame weaving machine providing warp threads to form a first part of the top and bottom plies;

Jacquard machines arranged on either side of the shaft frame weaving machine providing warp threads to form second and third parts of the top and bottom plies, the second and third parts being arranged on either side of the first part;

means for providing weft threads; and thread-redirecting members which guide an end of the weft thread in the top ply or bottom ply around an outer one of the warp threads to a closing position between a pair of warp threads in one of the second or third parts in the top ply or bottom ply, respectively.

15. The apparatus of claim 14 further comprising a control unit providing a control signal to control the Jacquard machines to alternatingly pattern the weave and pattern positions for the closing locations in the second and third parts.

16. The apparatus of claim 15 wherein the control unit also provides a second control signal to control the thread-redirecting members.

17. The apparatus of claim 16 wherein the control unit controls the thread-redirecting members to guides the weft thread in a path above and below the warp threads.

* * * * *